US005712671A

United States Patent [19]

Ono

[11] Patent Number: 5,712,671

[45] Date of Patent: Jan. 27, 1998

[54] THERMAL RECORDING METHOD AND APPARATUS VARYING THE NUMBER OF AUXILIARY HEATING PULSES BASED ON THE LENGTH OF TIME BETWEEN RECORDING OPERATIONS

[75] Inventor: Takeshi Ono, Yokohama, Japan

[73] Assignee: Canon Kabushiki Kaisha, Tokyo, Japan

[21] Appl. No.: 120,228

[22] Filed: Sep. 14, 1993

Related U.S. Application Data

[63] Continuation of Ser. No. 747,433, Aug. 13, 1991, abandoned, which is a continuation of Ser. No. 374,000, Jun. 30, 1989, abandoned.

[30] Foreign Application Priority Data

Jul. 1, 1988 [JP] Japan ..... 63-162604
Jun. 28, 1989 [JP] Japan ..... 1-163851

[51] Int. Cl.[6] ..... B41J 2/38; B41J 2/35

[52] U.S. Cl. ..... 347/186; 358/296

[58] Field of Search ..... 346/1.1, 76 PH; 358/296, 501, 502, 503; 400/120; 347/185, 186

[56] References Cited

U.S. PATENT DOCUMENTS

| | | | |
|---|---|---|---|
| 4,039,065 | 8/1977 | Seki et al. | 197/1 R |
| 4,449,136 | 5/1984 | Moriguchi | 346/76 PH |
| 4,568,817 | 2/1986 | Leng et al. | 346/76 PH |
| 4,633,269 | 12/1986 | Mikami | 346/76 PH |
| 4,760,462 | 7/1988 | Ogawa | 346/76 PH |
| 4,875,056 | 10/1989 | Ono | 346/76 PH |
| 5,019,836 | 5/1991 | Iwata et al. | 346/76 PH |

FOREIGN PATENT DOCUMENTS

| | | | |
|---|---|---|---|
| 0211473 | 12/1983 | Japan | 346/76 PH |
| 0003969 | 1/1987 | Japan | 346/76 PH |
| 0094360 | 4/1987 | Japan | 346/76 PH |
| 0135382 | 6/1987 | Japan | 346/76 PH |

*Primary Examiner*—Huan H. Tran

*Attorney, Agent, or Firm*—Fitzpatrick, Cella, Harper & Scinto

[57] ABSTRACT

A recording apparatus for recording on a recording medium includes plural heat generation-activated recording elements, and a discrimination circuit for discriminating the waiting time between the termination of a first recording operation and beginning of a second recording operation. Control circuitry is provided for varying, in accordance with the waiting time, the number of auxiliary heat generation operations for the recording elements in order to heat the elements to a temperature which is lower than a recording temperature and insufficient to perform recording.

4 Claims, 6 Drawing Sheets

THERMAL RECORDING METHOD AND APPARATUS VARYING THE NUMBER OF AUXILIARY HEATING PULSES BASED ON THE LENGTH OF TIME BETWEEN RECORDING OPERATIONS

This application is a continuation, of application Ser. No. 07/747,433 filed Aug. 13, 1991, which was a continuation of Ser. No. 07/374,000 filed Jun. 30, 1989, both now abandoned.

BACKGROUND OF THE INVENTION

1. Field of the Invention

The present invention relates to a recording method using heat generation in a recording element, and an apparatus therefor.

The recording apparatus may include a facsimile apparatus, a typewriter, a copying machine, a printer, or the like, and the recording method using heat generation in a recording element, to which the present invention is applicable, may include the so-called ink jet recording method, the thermal transfer recording method, the thermosensitive recording method, and the thermal recording method with current supplied to the sheet.

2. Related Background Art

In the following description, a facsimile apparatus utilizing the thermal recording method will be used as an example.

The recording unit of a conventional facsimile apparatus is equipped with a thermal line head provided with heat-generating recording elements in a line, and regenerates an image using line-by-line recording according to image data obtained by transmission or by reading an original document. In such recording, it is already known to effect, after the recording of each line, auxiliary recording in which the recording of the same data is repeated in order to prevent the temperature decrease of the thermal head during the waiting time until the start of recording for the next line.

Such auxiliary recording is usually conducted by activating the heat-generating elements for a period of about ½ to ⅓ of the normal recording time for a predetermined number of times (for example 4 times) while retaining the recording data until the data for the next line are fixed and the recording operation is started. The operation is so controlled that the auxiliary recording is terminated when a record start instruction for the next line is entered.

In the above-explained conventional example, the maximum number, for example 4 times, of the auxiliary recording operations is the same both in the standard mode with a sub-scanning line density of 3.85 lines/mm and in the super-fine made with a sub-scanning line density of 15.4 lines/mm. Thus the dots of the image become larger and eventually mutually overlap in certain reproduced images, thereby deteriorating the resolving power of the reproduced image.

Also in the G2 mode, in which the interval of recording is fixed but longer, the recording density may become insufficient because the thermal head is cooled with the ordinary number of auxiliary recordings. Also in the reduction copying operation in which the interval of recording is, somewhat prolonged in every two or three lines, the auxiliary recordings of ordinary number will raise the temperature of the head excessively so that the density of the reproduced image may become excessively high.

SUMMARY OF THE INVENTION

An object of the present invention is to provide a recording method, and an apparatus therefor, capable of improving the quality of the recorded image.

Another object of the present invention is to provide a recording method, and an apparatus therefor, capable of providing a clear recorded image.

Still another object of the present invention is to provide a recording method, and an apparatus therefor, capable of preventing deterioration in the resolution, resulting from insufficient density of the recorded image or dot expansion thereof.

Still another object of the present invention is to provide a recording method, and an apparatus therefor, capable of identifying the current recording mode and determining the maximum number of auxiliary recordings according to the interval of recording of said mode.

Still another object of the present invention is to provide a recording method, and an apparatus therefor, capable of preventing the deterioration in the resolution, resulting from insufficient density of the recorded image or dot expansion thereof, by identifying the current recording mode and determining the maximum number of auxiliary recordings according to the interval of recording of said mode.

DETAILED DESCRIPTION OF THE PREFERRED EMBODIMENTS

Now, the present invention will be clarified in detail by an embodiment thereof shown in the attached drawings.

In the following embodiment, the heat-generating resistors of the thermal line head are divided into plural blocks, and each block is driven by head driving means. Also the waiting time from the end of recording of one line to the start of recording in the next line is identified in advance, and, during said waiting time, said driving means is activated with a condition corresponding to said waiting time, thereby causing heating generation in the thermal line head. Also, the thermal recording apparatus of the following embodiment is applied to the recording unit of a facsimile apparatus, and the identifying means identifies the waiting time between lines according to the transmission-reception mode of the facsimile apparatus.

[Explanation of facsimile apparatus (FIG. 1)]

Figure 1:
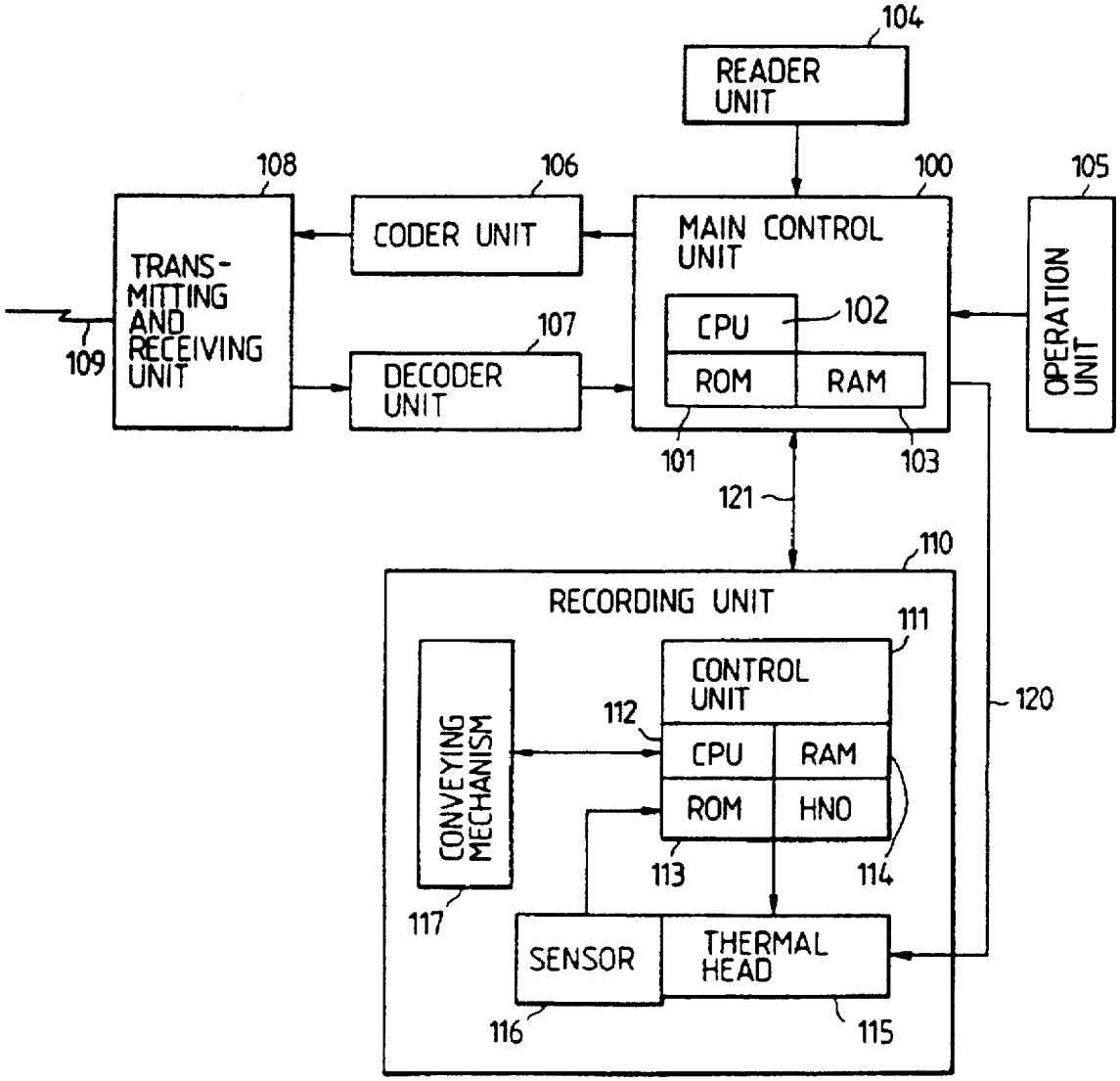
FIG. 1 is a block diagram of a facsimile apparatus embodying the present invention.

FIG. 1 is a block diagram schematically showing a facsimile apparatus embodying the present invention.

There are provided a main control unit 100 for controlling the entire facsimile apparatus, containing a CPU 102 for performing various control operations according to a control program stored in a ROM 101 and various data, and a RAM 103 used as a work area of the CPU 102 and serving for the temporary storage of various data; a reader unit 104 for photoelectrically reading an original document and entering corresponding signals (to be explained in relation to FIG. 7); and an operation unit 105 including an operation panel such as a keyboard to be manipulated by the operator for entering various instructions, and a display unit such as a liquid crystal display for displaying messages to the operator.

An encoder unit 106, for example for MH encoding of the image data of an original to be transmitted, encodes the image data from the main control unit 100 and sends the thus encoded data to a transmitting and receiving unit or a transmission/reception unit 108. A decoder unit 107 decodes the received image data into image data for supply to the main control unit 100. Also, said decoder unit supplies the main control unit 100, at the decoding of the received data, with information indicating whether the received data are in the standard mode or the fine mode. A transmission/reception unit 108 controls the transmission and reception to or from a communication channel such as a public telephone line.

A recording unit 110 executes image formation according to image data. A control unit 111 for controlling the recording unit 110 contains a CPU 112 such as a microprocessor, a ROM 113 storing the control program for the CPU 112, a RAM 114 used as the work area of the CPU 112, and an HNO for storing the number of auxiliary recordings designated by the main control unit 100. A thermal line head 115 has a length for example corresponding to the width (256 mm) of B4 size and is composed of 2048 dots or 2048 heat generating elements. In the present embodiment, said 2048 dots are divided into 4 blocks of 512 dots each, and each block is energized and driven to generate heat. In the present embodiment, each block is activated for a period of 0.6 ms at maximum, and the recording time for one line is 2.4 ms at maximum. A temperature sensor 116, such as a thermistor, is provided for detecting the temperature of the thermal head 115. A conveying mechanism 117 for the recording sheet contains a stepping motor for advancing the recording sheet, and a mechanism for sheet transportation, such as a platen roller 280*a* shown in FIG. 7.

Thus, in the reception of image data or in the recording of image signals from the reader unit 104, the main control unit 100 transfers the image data of one line to be recorded and clock signals synchronized therewith to the thermal head 115 through a signal line 120. When the data of one line to be recorded are transferred to the thermal head 115, a recording start instruction is supplied to the control unit 111 of the recording unit 110, and the aforementioned number of auxiliary recordings is simultaneously given to the control unit 111.

Figure 7:
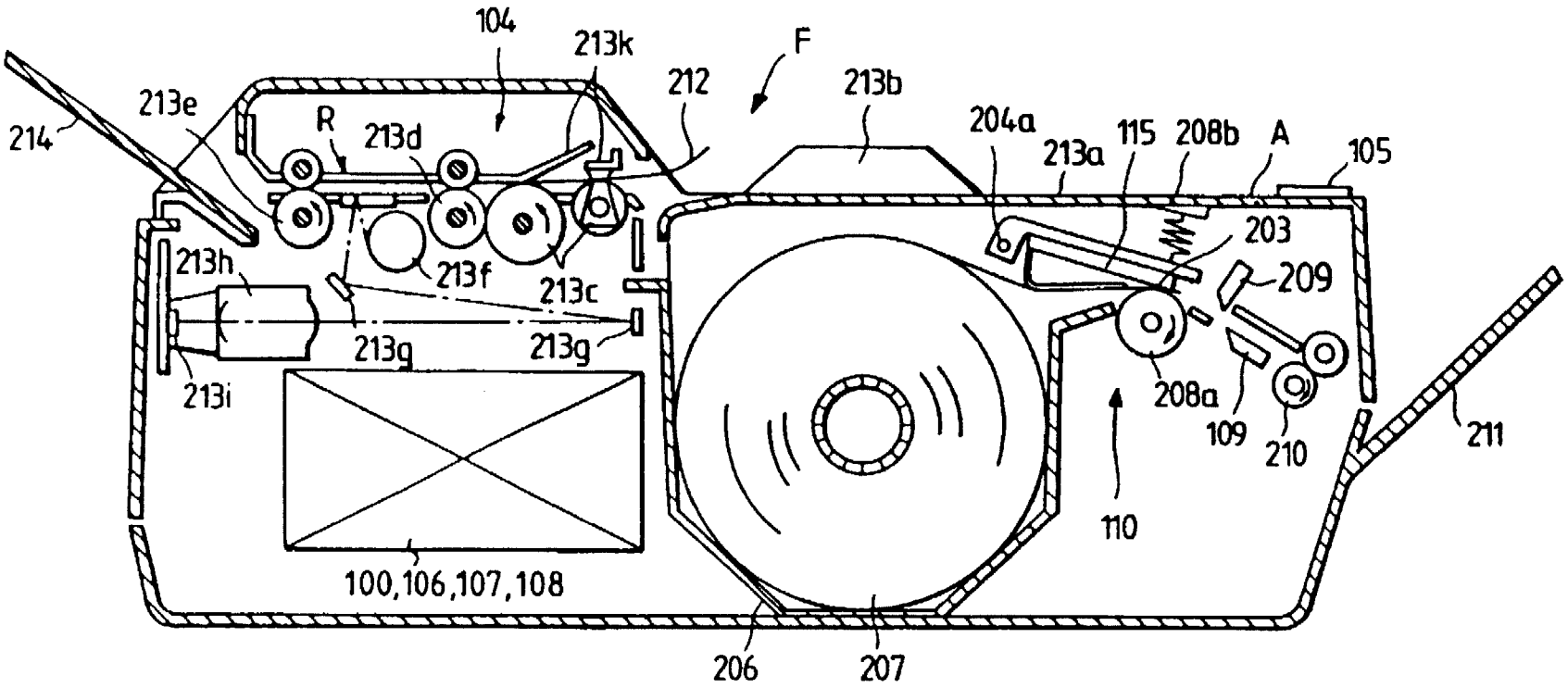
FIG. 7 is a lateral cross-sectional view of a facsimile apparatus embodying the present invention.

Upon receiving the recording start instruction and the number of auxiliary recordings corresponding to the recording mode from the main control unit 100, the control unit 111 stores said number in the HNO of the RAM 114. The specific examples of the number of auxiliary recordings corresponding to the recording mode will be explained later. At the same time the energizing time of the thermal head 115 is determined from a temperature signal of the sensor 116 and a table (storing pulse duration corresponding to each temperature) of the ROM 113, and each block of the thermal head 115 is energized with the thus determined energizing time to effect recording on a thermal recording sheet 207 (FIG. 7).

[Explanation of thermal head (FIG. 2)]

Figure 2:
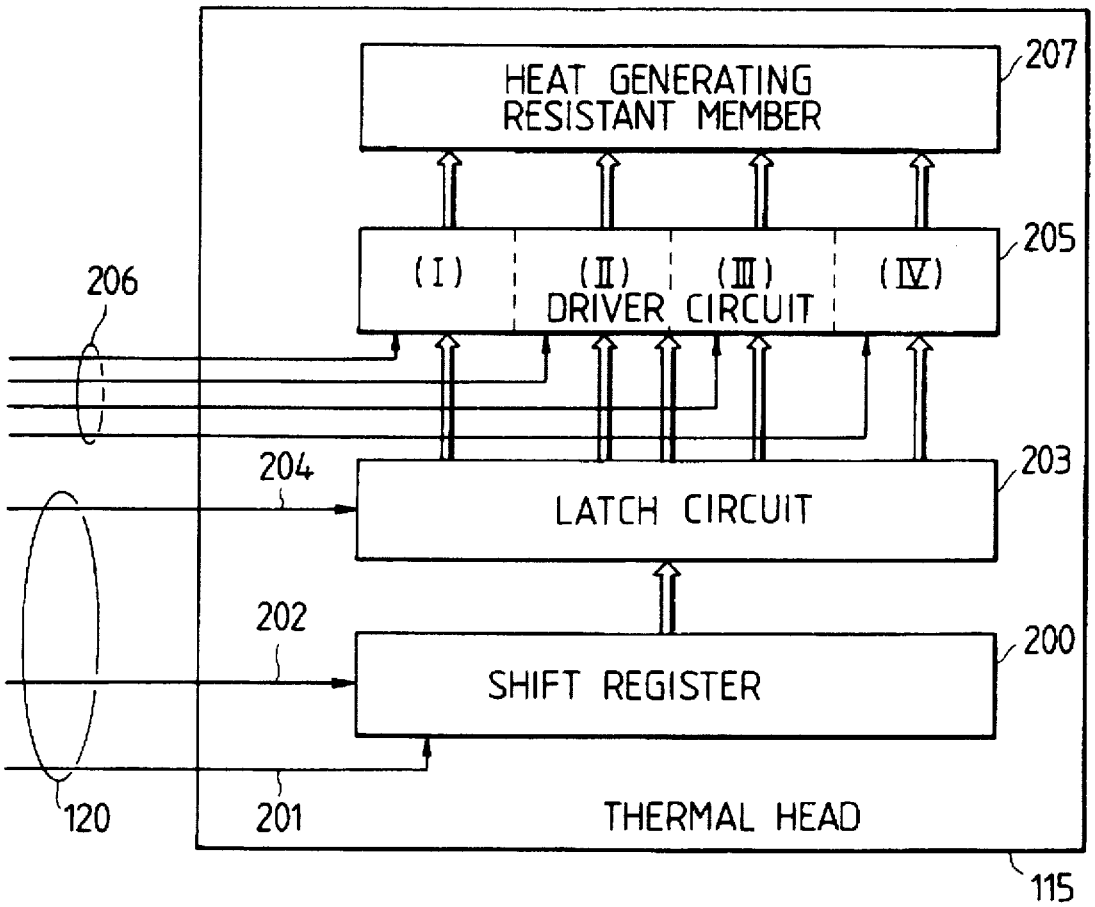
FIG. 2 is a block diagram of a thermal head embodying the present invention.

FIG. 2 is a block diagram of the thermal head 115 employed in the present embodiment.

A shift register 200 capable of storing serial dot data of 2048 bits receives the image data from the main control unit 100 in the form of serial data 202 synchronized with clock signals 201. A latch circuit 203 latches the data of 2048 bits of the shift register 200 in response to a latch signal 204 from the control unit 111. A driver circuit 205 receives the recording data from the latch circuit 203 and a strobe signal 206 from the control unit 111, and drives blocks (I)–(IV) of heat-generating resistors.

[Function of main control unit (FIGS. 1–3)]

Figure 3:
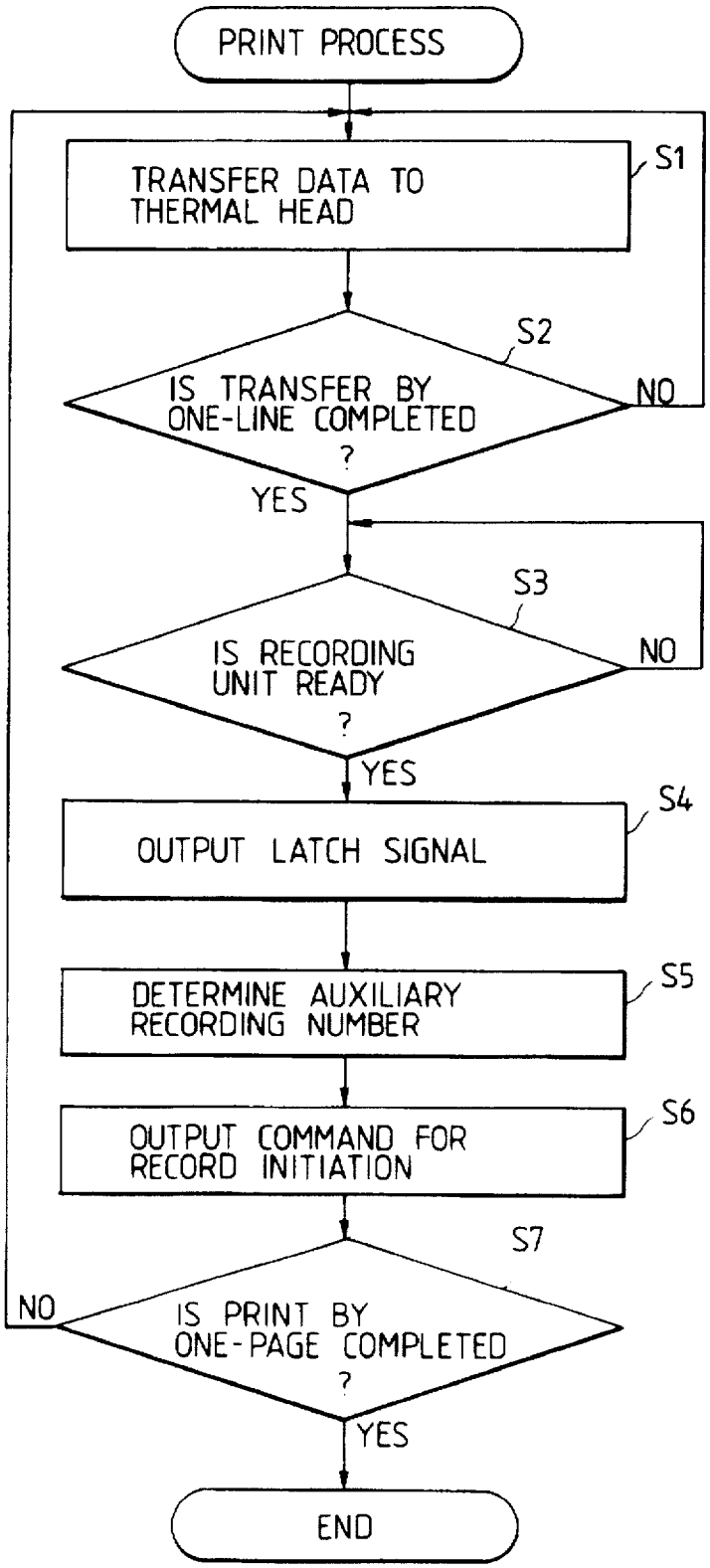
FIG. 3 is a flow chart showing the control sequence of a main control unit in a page print operation.

FIG. 3 is a flow chart showing the control sequence of a page recording performed by the CPU 102 of the main control unit 100, and the corresponding control program is stored in the ROM 101.

This sequence is activated by the reception of image data or by the start of a copying operation. First at a step S1 a clock signal 201 and serial data 202 are generated, thus transferring the recording data to the shift register 200 of the thermal head 115. A Step S2 it is discriminated whether the transfer of recording data of one line to the shift register 200 has been completed, and, if not completed, the sequence returns to the step S1.

When the recording data of a line have been transferred to the shift register 200, the sequence proceeds to a step S3 at which it is discriminated whether the control unit 111 of the recording unit 110 is busy, namely whether the recording operation performed, by the thermal head 115 is in progress, by a status signal on a signal line 121 from the recording unit 110. In case of the busy state, there is awaited the completion of recording of the line, and the sequence proceeds to a step S4 upon completion of the recording or when it is not busy.

At the step S4 a latch signal 204 is generated to latch the content of the shift register 200 in the latch circuit 203. Then at a step S5 the recording mode is checked and the number of auxiliary recordings is determined. More specifically, the maximum number of auxiliary recordings is determined by inspecting the reception mode signal, such as G2, G3 or G4, from the decoder unit 107 or by detecting the copy mode such as a reduction copying. For example, the maximum number of the auxiliary recordings is determined as 0 for the equal-size copying, 1 time for the reduction copying, 3 times for the super fine mode of 15.4 lines/mm, 4 times for the standard mode of 3.85 lines/mm, and 5 times for the G2 mode. In the present embodiments, each block is driven for 0.1–0.3 m/sec. in the auxiliary recording, while as already explained before, each block is driven for 0.6 m/sec. at maximum in the main recording operation.

Then at a step S6 a record start command is applied to the recording unit 110, and at a step S7 it is discriminated whether the data output of a page has been completed, and, if not, the sequence returns to the step S1 for transferring the recording data of a next line to the thermal head 115.

[Function of control unit 111 (FIGS. 1–4)]

Figure 4:
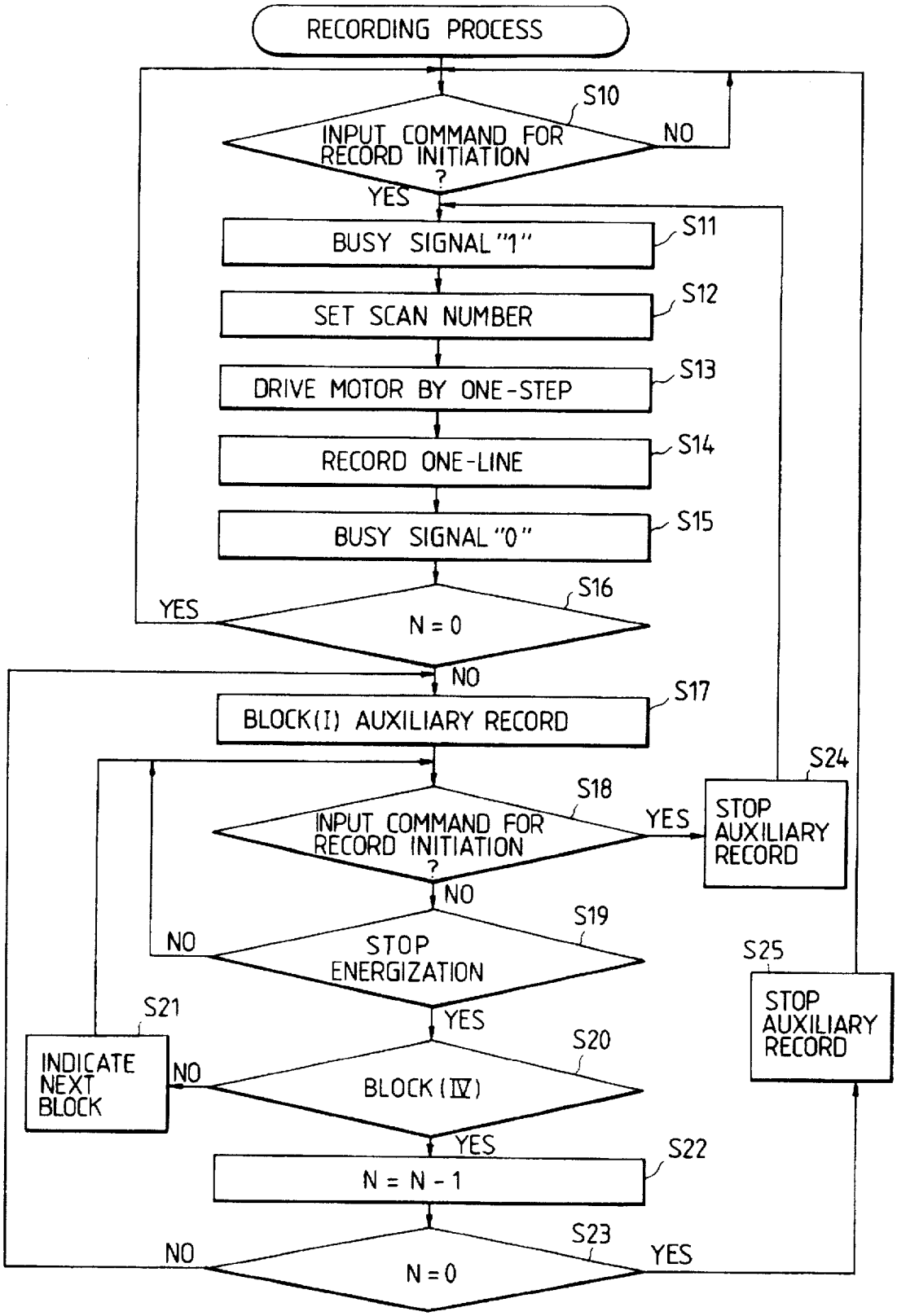
FIG. 4 is a flow chart showing the recording operation of a control unit in a recording unit.

FIG. 4 is a flow chart showing the control sequence of the control unit 111 of the recording unit 110 of the present embodiment, and a corresponding control program for the CPU 112 is stored in the ROM 113.

At a step S10 the record start command is received from the CPU 102 of the main control unit 100, and at a step S11 the busy signal to the main control unit 100 is shifted to "1", thereby prohibiting a next record start command from the main control unit 100. Then at a step S12 the number of auxiliary recordings designated by the main control unit 100 is set in the HNO of the RAM 114, and at a step S13 the sheet conveying mechanism 117 is driven, thereby conveying the recording sheet by one line.

Then, in response to the temperature signal from the temperature sensor 116, at a step S14 the pulse width of the strobe signal 206 is determined, which is supplied to the heat-generating element 207 of the thermal head 115 at the recording operation. The time required for recording is fixed as 2.4 m/sec. for one line and 0.6 m/sec. per block at maximum. Thus the duration of power supply to the heat-generating element in the period of 0.6 m/sec. is determined by a table stored in the ROM 113, in response to the temperature signal from the temperature sensor 116. The above-mentioned period of 2.4 m/sec. is determined in response to the moving speed of the recording sheet.

After the recording of one line at the step S14, the sequence proceeds to a step S15 for turning off the busy signal, thereby enabling the entry of a next record start command from the CPU 102.

Then at a step S16 it is discriminated whether the maximum record number for auxiliary recording (HNO) is "0", and, if it is "0", the auxiliary recording is not necessary, thus the sequence returns to the step S10. On the other hand, if at the step S16 if HNO is not "0", at a step S17 the pulse width of the strobe signal 206 for the auxiliary recording is determined and the auxiliary recording for the block I is performed. The auxiliary recording is to prevent white streak or deficiency in density caused by the cooling of the thermal head 115 resulting in the waiting time until the start of next recording, and is conducted for a period of a degree of ⅓–¼ of the pulse duration or width of the strobe signal in the recording operation.

In the present embodiment, this pulse width is determined for each line with reference to a table different from the table for determining the pulse width for the actual recording, thereby regulating the temperature of the heat-generating elements of each block of the thermal head 115 and preventing the decrease in the recording density.

When the power supply is started to heat-generating elements of the block I of the thermal head 115 at the step S17, at a step S18 it is discriminated whether a next record start command is applied from the main control unit 100, and, if not, at a step S19 it is discriminated whether the output period of the strobe signal 206 has reached the energizing period for auxiliary recording. When the period of auxiliary recording has elapsed, the sequence proceeds to a step S20 at which it is discriminated whether the energization of the last block IV has been completed. If not, the sequence proceeds to a step S21 to effect the auxiliary recording by energizing the heat-generating elements of a next block. In this manner the blocks I–IV are driven in succession to generate heat in the steps S18 to S21.

If at the step S20 the auxiliary recording of the block IV is performed, the sequence proceeds to a step S22 at which the value of the HNO is reduced by one, and at a step S23 it is discriminated whether the value is equal to "0". If the value of the HNO is "0", at a step S25 the auxiliary recording is terminated and the sequence returns to the step S10. On the other hand, if the value is not "0", the sequence returns to the step S17 to execute the auxiliary recording again from the block I.

On the other hand, if at the step S18 the record start command from the main control unit 100, is inputted the sequence proceeds to a step S24 for turning off all the strobe signals 206 and returns to the step S11 thereby starting the main recording for a next line.

[Timing of auxiliary recording process]

Figure 5:
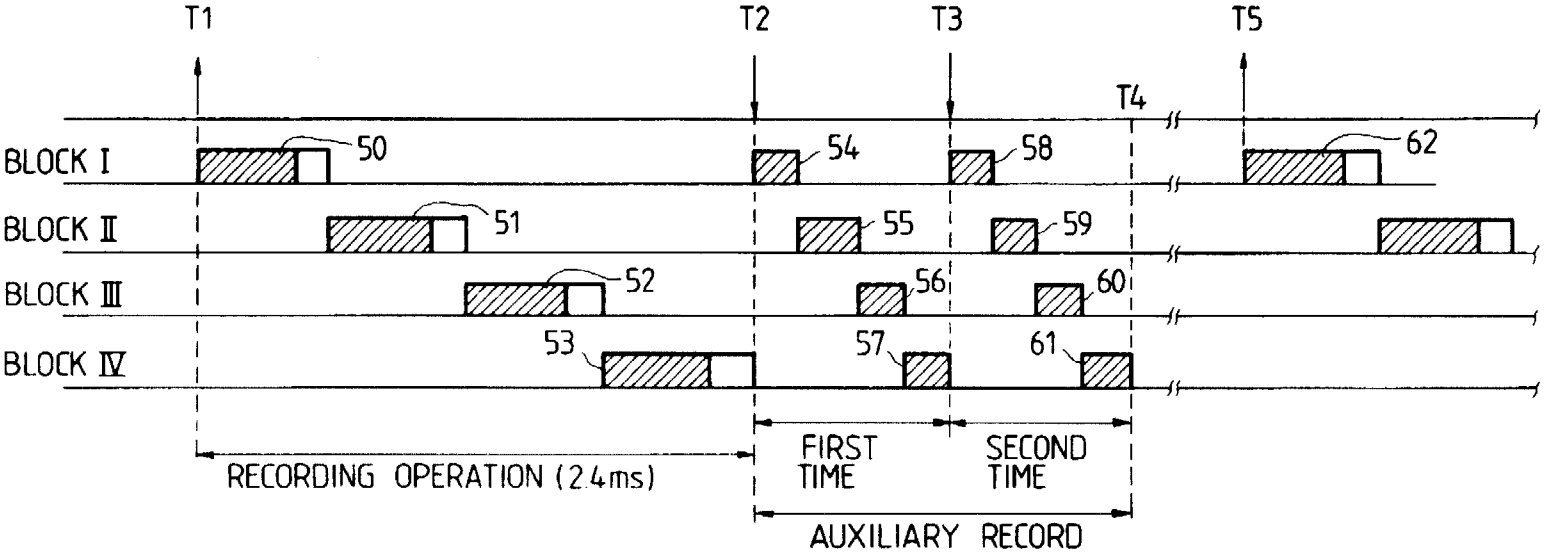
FIG. 5 is a timing chart showing the timing of main recording and auxiliary recording in an embodiment of the present invention.

FIG. 5 shows an example of the timing of auxiliary recording in the recording unit 110.

In response to the input of the record start command from the main control unit 100 at a timing T1, recording is performed in each of four blocks as indicated by numerals 50–53. The recording of one line is completed when the recording or energization 53 of the fourth block is terminated. The recording time for one line is about 2.4 m/sec. as explained before, while the energization time of each block is 0.6 m/sec. at maximum, and the actual energization time for recording within said 0.6 m/sec. is indicated by a hatched area. The above-mentioned recording time corresponds to the time required for advancing the recording sheet by one step.

After the actual recording operation is completed, the auxiliary recording is started at a timing T2. A numeral 54 indicates the timing of auxiliary recording for the block I, and the time period of energization of each block is, as explained before, about ⅓ of that of the actual recording. The auxiliary recording (first time) for four blocks is thus performed in succession as indicated by numerals 54–57, and, if the record start command is not inputted during the auxiliary recording, the auxiliary recording of second time is started from the block I again as indicated by a numeral 58.

When the auxiliary recording for example of the second time, designated by the main control unit 100, is completed at a timing T4, the strobe signals 206 are all turned off and the next record start command is awaited. Then, in response to the input of the record start command for the next line at a timing T5, the recording operation is conducted for each block of four blocks in succession in a similar manner as explained above.

It is needless to say if a record start command is inputted from the main control unit 100 during the auxiliary recording, the strobe signal 206 is turned off immediately to terminate the auxiliary recording operation.

The maximum number of auxiliary recording is determined by the main control unit 100 with reference to the following table:

TABLE

| Mode | | | Maximum number of scan |
|---|---|---|---|
| Copy | Equal size | | 0 |
| | Reduction | | 1 |
| Reception | G3 | Standard | 4 |
| | | Fine | 4 |
| | | Super Fine | 3 |
| | G2 | | 5 |

[CPU of control unit 111 (FIG. 6)]

Figure 6:
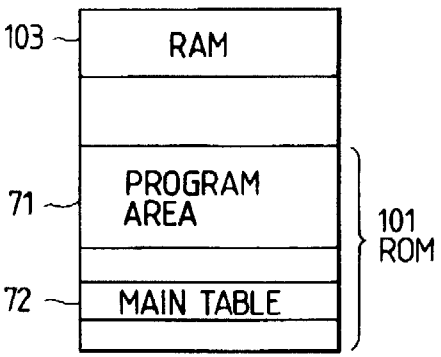
FIG. 6 is a memory map of a CPU of the recording unit.

FIG. 6 is a memory map of the CPU 112 controlling the function of the control unit 111 of the recording unit 110.

There are shown a RAM area 103 for the CPU 112; a control program area 71 for the CPU 112; and a pulse width table 72 for determining the pulse width of the strobe signal 206 at the main recording operation. The table 72 is referred to, in determining the energization period for main or actual recording at the step S13 as shown in the flow chart of FIG. 4, based on the value of the temperature sensor 116 of the thermal head 115, and the pulse width of the strobe signal 206 is determined with reference to the table, based on the temperature.

Now, reference is made to FIG. 7 for explaining a facsimile apparatus in which the foregoing embodiment is applied.

In FIG. 7 there are shown a facsimile apparatus F; and a roll holder 206. The roll holder 206 contains, in drop-in manner, a roll-like thermal recording sheet 207 which is subjected to recording in a recording unit 110, then cut by a cutter 209 at the rear end of the image after recording, discharged from the apparatus by discharge rollers 210, and received by a tray 211.

The recording unit 110 is provided with a platen roller **208*a* (driven by the aforementioned stepping motor belonging to the conveying mechanism) for stepwise conveying the recording sheet 207, and the aforementioned line-type thermal head 115 pressed to the roller 208***a* by means of a spring 208*b*, thereby effecting recording on the thermal recording sheet 207 according to the image signal. 204*a* indicates a pivot of the thermal head 115.

In an original reading unit 104, there is provided an original mounting base 213*a* formed on an upper surface of cover A. Original documents 212 mounted on the base 213*a* with the face to be read opposed to the base are guided on both sides thereof by side guides 213*b*, and are separated one by one by a separating roller 213*c*. The separated original document is conveyed stepwise by a conveying roller 213*d* to a reading position R. After an original surface of the original document is read at the reading position R, the original document 212 is discharged by a discharge roller 213*e* onto a discharge tray 214. A separating member 213*k* is pressed to the separating roller 213*c*.

During the conveyance of the original document 212 at the reading position R, the face of said original document is illuminated by a light source 213*f*, and the reflected light is guided to a CCD 213*i* through plural mirrors 213*g* and a lens 213*h*. The image of the original document is thus read, and the obtained image signal is transmitted to the recording unit of this or other apparatus.

In the facsimile apparatus F of the present embodiment, the thermal head is controlled in the same manner as explained in the foregoing embodiment.

In the foregoing embodiments the transfer of the recording data to the thermal head 115 and the latching of the recording data in the thermal head are conducted by the main control unit 100, while driving of the thermal head and the conveyance of the recording sheet are controlled by the recording unit, however it is also possible to effect these conveyance control operations for the thermal head and the recording sheet solely by the main control unit with logic circuits such as a gate array.

Also the determination of the number of auxiliary recordings by the main control unit 100 may be depend on all the modes that are considered to affect the recording period, such as the copying mode (same size or reduction), transmission mode (G2 or not), encoding mode (MF1 or not), sub-scanning density, image data mode (halftone or binary) etc.

Also in the foregoing embodiments, the energy applied during the auxiliary recording is regulated by the number thereof, but such regulation is likewise achievable also by the voltage or current applied to the thermal head, or by the pulse width of the strobe signal.

The foregoing embodiments are described as to a thermal printer applied to a facsimile system, however, they are also applicable likewise to other thermal printers which record the data transmitted over a relatively long period.

Thus, the foregoing embodiments provide a satisfactory reproduced image, free from deterioration of resolution caused either by a density insufficiency effected by an insufficient temperature of the thermal head in various recording modes, or by a dot expansion caused by excessive temperature increase of the thermal head.

As detailedly explained in the foregoing, the present invention prevents the deterioration in resolution caused by insufficient density or dot expansion in the recorded image, thereby improving the quality of the recorded image, by varying the driving condition of the auxiliary recording.

What is claimed is:

1. An image communication apparatus, comprising:

reading means for reading data corresponding to an original image;

receiving means for receiving data transmitted from other image communication apparatus;

recording means for recording an image on a recording medium by driving plural heat generation-activated recording elements in accordance with the data received by said receiving means or the data read by said reading means in accordance with an input of a recording command;

determining means for determining a maximum number of auxiliary heat generation operations to be performed between a recording operation by said recording means and a next recording operation by said recording means, said determining means determining the maximum number of auxiliary heat generation operations so that the maximum number at a facsimile mode for recording the image corresponding to data transmitted through a predetermined communication mode is larger than that at a copy mode for recording data read by said reading means at a predetermined magnification;

counting means for counting an execution number of auxiliary heat generation operations executed between a recording operation and a next recording operation; and control means for controlling said recording means to execute the auxiliary heat generation operations between a termination of said recording operation and a commencement of said next recording operation, wherein said control means ceases execution of additional auxiliary heat generation operations by inputting the recording command for the next recording operation until said counting means counts the maximum number, and ceases the execution of additional auxiliary heat generation operations without an input of the recording command for the next recording operation after said counting means counts the maximum number.

2. An apparatus according to claim 1, wherein said determining means further differentiates the maximum number of auxiliary heat generation operations in accordance with a communication mode of the data transmitted from the other image communication apparatus at said facsimile mode.

3. An apparatus according to claim 1, wherein said determining means further differentiates the maximum number of auxiliary heat generation operations in accordance with a copying magnification at said copying mode.

4. An apparatus according to claim 1, wherein said recording means drives said heat-generation-activated recording elements to perform recording on a thermosensitive paper.

* * * * *

UNITED STATES PATENT AND TRADEMARK OFFICE

CERTIFICATE OF CORRECTION

PATENT NO. : 5,712,671

DATED : January 27, 1998

INVENTOR(S): TAKESHI ONO

It is certified that error appears in the above-identified patent and that said Letters Patent is hereby corrected as shown below:

COLUMN 1
Line 49, "made" should read --mode--; and
Line 60, "of" should read --of an--.

COLUMN 2
Line 62, "are" should read --is--.

COLUMN 3
Line 59, "of" (first occurrence) should read --stored in--.

COLUMN 4
Line 17, "A" should read --At--; and "Step" should read --step--;
Line 21, "have" should read --has--.

COLUMN 5
Line 18, "if" should be deleted;
Line 21, "streak" should read --streaks--.
Line 33, after "to" add --commence auxiliary recording using--;
Line 57, "100, is inputted" should read --100 is inputted,--.

UNITED STATES PATENT AND TRADEMARK OFFICE

CERTIFICATE OF CORRECTION

PATENT NO. : 5,712,671

DATED : January 27, 1998

INVENTOR(S): TAKESHI ONO

It is certified that error appears in the above-identified patent and that said Letters Patent is hereby corrected as shown below:

COLUMN 6

Line 16, "of" should read --of a--;

Line 59, "are" should read --is--; and "F;" should read --F--.

COLUMN 7

Line 60, "detailedly explained" should read --explained in detail--.

Signed and Sealed this

Eighteenth Day of August, 1998

Bruce Lehman

*Attest:*

BRUCE LEHMAN

*Attesting Officer*

*Commissioner of Patents and Trademarks*